United States Patent [19]

Ilukowicz

[11] 4,085,559

[45] Apr. 25, 1978

[54] HOG SLAT REINFORCING BAR SUPPORT

[75] Inventor: Robert J. Ilukowicz, Coram, N.Y.

[73] Assignee: Preco Industries, Ltd., Plainview, N.Y.

[21] Appl. No.: 708,122

[22] Filed: Jul. 23, 1976

Related U.S. Application Data

[63] Continuation-in-part of Ser. No. 625,635, Oct. 24, 1975, Pat. No. 4,007,572.

[51] Int. Cl.[2] ..... E04C 5/16; E04G 17/06

[52] U.S. Cl. ..... 52/687

[58] Field of Search ..... 52/687, 685, 686, 688; 119/20, 27, 28; 249/40

[56] References Cited

U.S. PATENT DOCUMENTS

| | | | |
|---|---|---|---|
| 1,268,887 | 6/1918 | Schroeder | 52/687 |
| 1,841,699 | 1/1932 | Bauman | 52/687 |
| 1,880,710 | 10/1932 | Bitney | 52/687 |
| 3,530,634 | 9/1970 | Adams | 52/687 |
| 3,788,025 | 1/1974 | Holmes | 52/687 X |

FOREIGN PATENT DOCUMENTS

| | | | |
|---|---|---|---|
| 2,228,868 | 1/1974 | Germany | 52/687 |
| 904,766 | 8/1962 | United Kingdom | 52/687 |

*Primary Examiner*—J. Karl Bell

*Attorney, Agent, or Firm*—Posnack, Roberts, Cohen & Spiecens

[57] ABSTRACT

A hog slat reinforcing bar support comprising a one-piece plastic body with spaced support portions for respective reinforcing bars. Each portion includes a surrounding wall with an opening through which the associated reinforcing bar can be inserted and held within the support portion. The portions may be connected by a connection piece with projecting members extending laterally from the body and defining a plurality of support points by which the body can be stabily supported in a trapezoidal hog slat form. The portions may alternatively be supported on a structure in the shape of an A-frame.

10 Claims, 11 Drawing Figures

HOG SLAT REINFORCING BAR SUPPORT

OTHER APPLICATIONS

This application is a Continuation-in-part of my earlier filed co-pending application Ser. No. 625,635 filed Oct. 24, 1975 now U.S. Pat. No. 4,007,572.

FIELD OF THE INVENTION

This invention relates to hog slat reinforcing bar supports and the like adapted for supporting reinforcing bars within a hog slat form or the like.

BACKGROUND OF THE INVENTION

In the conventional type of concrete hog slats (i.e., slender forms of trapezoidal cross-section), reinforcing bars may be provided at the top and bottom. The bottom reinforcing bar is initially supported within the casting from for the slat by suitable means so as to hold the bar in position and the top bar is hand placed after pouring of the concrete into the form. Centering of the bars is accomplished by eye and usually is inaccurate by virtue of the lack of lateral restraint. Additionally, it is very difficult to place the top bar accurately at a given position in the concrete.

Some supports are known for supporting reinforcing bars in spaced positions. These include such supports as disclosed in U.S. Pat. Nos. 1,268,887; 1,880,710; 3,530,634 and 3,694,989 as well as in British patent specification No. 904,766. These known structures are believed to be less suitable for withstanding the weight of reinforcing bars than is desirable for the purpose.

SUMMARY OF THE INVENTION

An object of the invention is to provide a support member for reinforcing bars in a hog slat form, which will maintain such bars in given position so that they are accurately placed in the resulting concrete hog slat.

Another object of the invention is to provide a support member of the above type which includes a structure most suitably adapted for supporting the weight of reinforcing bars thereby being adapted for stably supporting the reinforcing bars within the form.

In accordance with the above and further objects, the invention contemplates a hog slat reinforcing bar support comprising a one-piece plastic body including spaced support portions for respective reinforcing bars, each portion including a surrounding wall with an opening through which the associated reinforcing bar can be inserted with a snap fit, means connecting said portions, and projecting members defining a plurality of support points by which the body can be stably supported in a form and the reinforcing bars held in predetermined positions within said form whereby the reinforcing bars will be placed within the cast body at predetermined position therein.

In accordance with one embodiment of the invention, said support portions are aligned and said connection means comprises a straight connecting piece joining said support portions.

In this embodiment, the projecting members preferably include two pairs of arms extending laterally with respect to said straight connecting piece for engaging the side walls of the form to provide lateral restraint. Moreover, one of the projecting members projects from the bottom of the body in alignment with the connecting piece for support of the body on the bottom of the form.

In further accordance with the invention, the opening in each wall is smaller in size than the corresponding support portion whereby the reinforcing bars are forcibly inserted into the respective support portion and tightly maintained therein.

In accordance with another embodiment, the structure is of A-shape with a plurality of snap-fit sockets distributed thereabout for receiving reinforcing bars.

The invention will be described in greater detail hereafter with reference to the annexed drawing.

DETAILED DESCRIPTION

Figure 1:
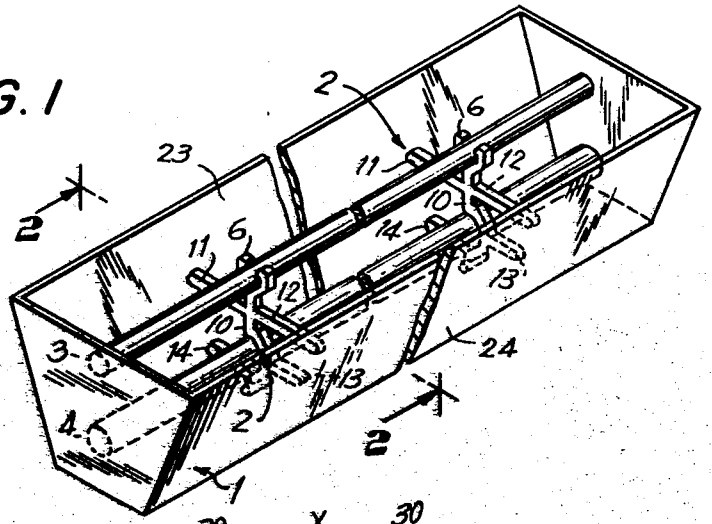
FIG. 1 is a perspective view, partly broken away showing a hog slat form with two supports and reinforcing bars mounted therein.

Referrring to FIG. 1 of the drawing, therein is seen a form 1 of wood or other suitable material assembled in trapezoidal cross-section for receiving concrete to produce a hog slat which is a reinforced concrete beam of trapezoidal cross-section. Hog slats are well known in the art. In use, hog slats are placed closely together in side-by-side relation with their wide ends facing upwardly to form a "slotted floor" for cattle, hogs and sheep. The hog slats are uniformly spaced and the openings between the slats permit the animal wastes to be worked by the feet of the animal through the floor into a gutter or pit therebelow for later processing into fertilizer. As a consequence, the animals remain relatively dry and clean. Such slats of reinforced concrete are durable and can be cast in a wide variety of sizes depending on the use of the floor for particular animals.

In order to support the weight of the animals, it is necessary to provide reinforcing bars at the top and bottom of the hog slats and in general, a number 4 ($\frac{1}{2}$ inch) steel bar is provided $\frac{3}{4}$ inch from the bottom and a number 3 ($\frac{3}{8}$ inch) steel reinforcing bar is provided $\frac{3}{4}$ inch from the top. The reinforcing bars may be centered along the vertical axis of symmetry of the hog slat.

Heretofore it was conventional to mount the lower reinforcing bar in the form by means of suitable clips or the like, and after the concrete was poured, the top bar was handplaced in the concrete. Centering was effected by eye and was usually inaccurate as there was no lateral restraint. Furthermore it was very difficult to place the top reinforcing bar accurately at a depth of $\frac{3}{4}$ inch in the concrete.

The invention contemplates the placement of at least two support members 2 within the form 1 so as to support and maintain reinforcing bars 3 and 4 therewithin at pre-determined locations. Namely, the support members 2 position the reinforcing bars 3 and 4 in the center plane of the form and at specific distances from the top and bottom thereof. The support of the reinforcing bars 3 and 4 members 2 is such that their position will be undisturbed in the course of pouring of concrete, whereby the reinforcing bars will occupy precise positions in the cast slat.

Figure 2:
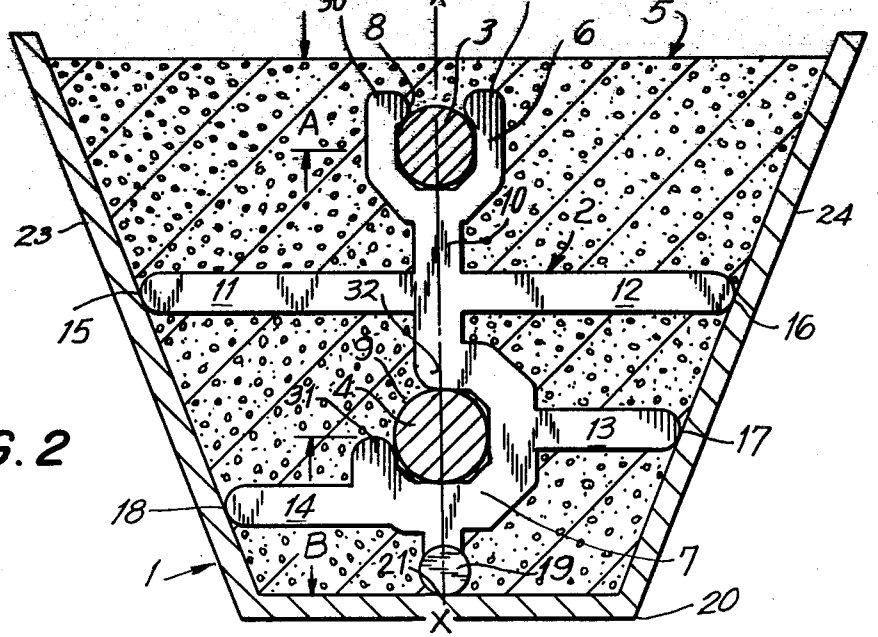
FIG. 2 is a transverse sectional view taken along line 2—2 in FIG. 1 showing one embodiment of the invention.
Figure 5:
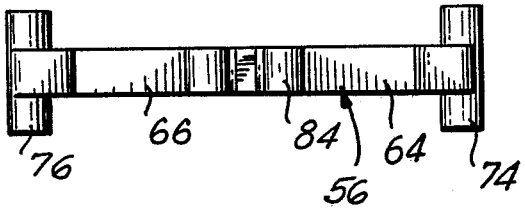
FIGS. 5, 6 and 7 are respectively top, bottom and side views of the embodiment of FIG. 4.
Figure 4:
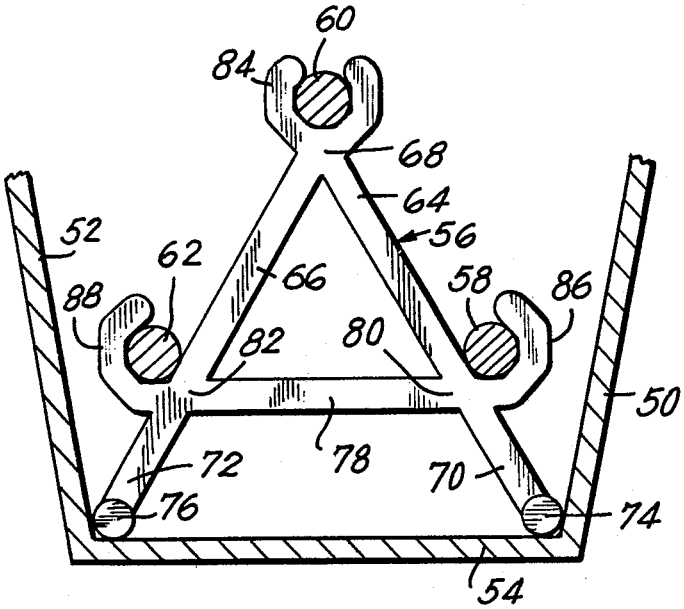
FIG. 4 is a front view of a third embodiment.
Figure 7:
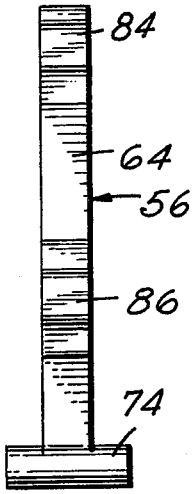
Figure 6:
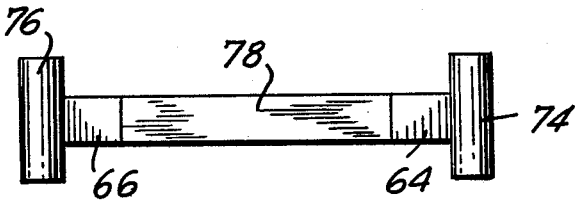
Figure 11:
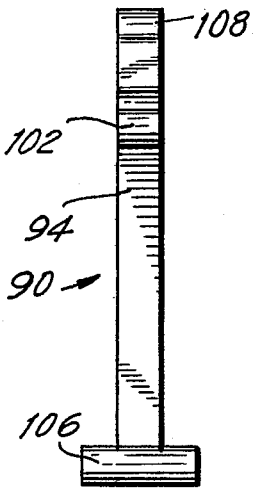
FIGS. 9, 10 and 11 are respectively top, bottom and side views of the embodiment of FIG. 8.
Figure 9:
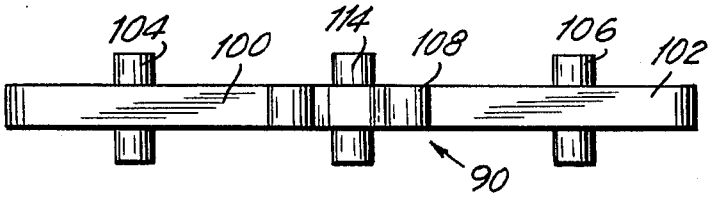

Referring more specifically to FIG. 2, therein it can be seen that the reinforcing bars 3 and 4 are placed in exact vertical alignment along the vertical axis of symmetry of the form 1. Moreover, the centers of bars 3 and 4 are respectively positioned at distances A and B from the top and bottom of the cast slat 5.

By virtue of the perfectly centered position of the bars 3 and 4, an accurate position of the reinforcing bars will be obtained in the slat and this produces a high quality slat which is of constant strength and is reliable in use for the formation of the slotted floor while being perfectly capable of reliably bearing the weight of the animals thereon.

Referring now to the support member 2 in greater detail, it is seen that this member is made from a one-piece body of plastic material such as PVC, nylon, polyethylene, etc. The body includes first and second support portions or sockets 6 and 7 for the reinforcing bars 3 and 4 respectively. Each portion is composed of a surrounding wall which has an opening through which the associated reinforcing bar can be inserted. As seen in FIG. 2, portion 6 has an opening defined by bulbous lips 8 while portion 7 has an opening 9. Portions 6 and 7 in vertically aligned relation so that the reinforcing bars will be disposed exactly one above the other. Lips 8 lock in the associated rod.

The body furthermore includes a first upper pair of laterally projecting arms 11 and 12 and a second pair of laterally projecting arms 13 and 14. The arms 11 and 12 are located at the same level and extend laterally so as to engage the inclined side walls 23 and 24 of form 1 at points 15, 16. The arm 13 of the second pair contacts lateral wall 24 at point 17 and the arm 14 contacts lateral wall 23 at point 18. The ends of the lateral arms are all rounded so as to define clearly the contact thereof with the side walls of the form. As a consequence of the four points of support of the arms on the support member with the inclined side walls of the form, the support 2 will be stably supported and laterally restrained.

At the bottom of the support member there is a further projecting arm 19, which contacts the bottom wall 20 of the form at 21. The arm 19 is of cylindrical shape so as to provide a definite line of contact at 21. As can be seen, the arm 19 is aligned with the connecting piece 10, and these are disposed along the vertical axis of symmetry X — X of the form 1. Thereby reinforcing members 3 and 4 will be precisely positioned on axis X — X.

The operation of installing the reinforcing bars within the form is as follows:

Each reinforcing bar is inserted through the associated opening into the corresponding support portion of at least two supports 2. The size of the opening in each support is such that the reinforcing bar is forcibly inserted into its supporting portion. The free ends 30 of the supporting portion 6 are so positioned to forcibly hold the reinforcing bar 3 within the supporting portion.

The supporting portion 7 has a free end 31 facing the opposed portion 32 bounding opening 9 so that when bar 4 is inserted in portion 7 it will be elastically retained therein.

The assembly of bars and supports is then inserted into the corresponding hog slat form, and the ends of the laterally projecting arms contact the side walls of the form. It is also possible to first position the supports 2 in the form and then insert the reinforcing bars 4 and 3 into the same. In either case, the reinforcing bars will be exactly positioned and stably held in position within the cast concrete hog slat.

In order to insure the tight engagement of the free ends 30 of the support portion 6 with the reinforcing bar 3, the arms 11 and 12 are connected to the connecting piece 10 thereby leaving the ends 30 free to elastically deform.

The arm 13 laterally projects from the center of support portion 7, while the arm 14 projects on the opposite side, at a lower level, from the bottom of support portion 7. Thereby, the end 31 is free to deflect and reinforcing bar 4 can be forced into support portion 7 and supported therein without any interference by the arms 13 and 14. Moreover, the slightly upwardly facing disposition of opening 9 and the opposed relation of arm 13 at the center of support portion 7 insures that the reinforcing bar 4 can be forcibly inserted into the support portion 7 without upsetting the position of the support 2.

Figure 3:
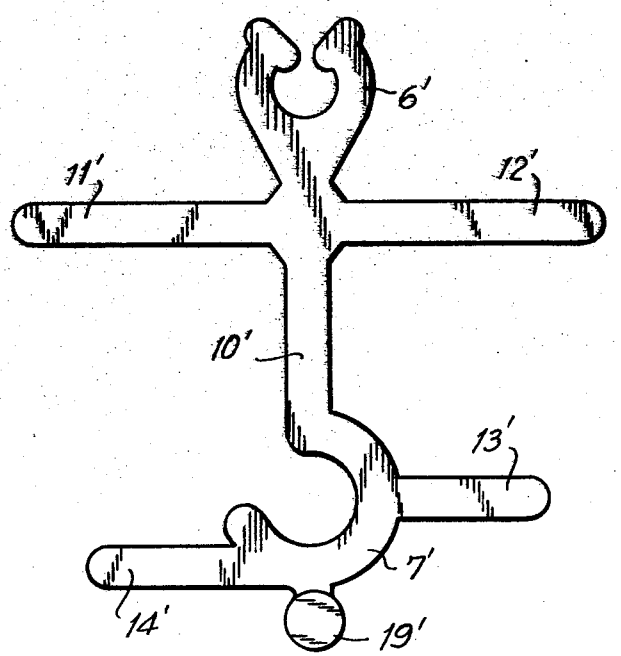
FIG. 3 is a front elevation view of a second embodiment of the invention.

FIG. 3 shows a modified embodiment and herein the same numerals with primes are employed for elements corresponding to those in the embodiment of FIG. 2. In this embodiment, the support is intended to be used with a deeper hog slat and for this purpose connecting piece 10′ is of greater length than connecting piece 10 in the previously described embodiment. Additionally, as seen, the support portions 6′ and 7′ define circular support surfaces rather than the polygonal surfaces as in the embodiment in FIG. 2. In view of the greater length of connecting piece 10′, the arm members 11′ and 12′ are positioned at the juncture of support portion 6′ and connecting piece 10′, so as to form a rigid connection thereat.

The sizes of the hog slats can vary and some typical sizes are given hereafter, the first number representing the length of the narrow side of the hog slat, the second dimension the length of the wide side of the hog slat and the third dimension the height of the hog slat:

3: 5: 4; inches 3: 5: 5; inches and 5: 5: 7 inches.

The slats can be approximately 6–10 feet long. As previously noted, the reinforcing bar 3 is generally of $\frac{3}{8}$ inch diameter and the reinforcing bar 4 of $\frac{1}{2}$ inch diameter.

FIGS. 4–7 illustrate a further embodiment of the invention in accordance with which a reinforcing bar support is accommodated within a trapezoidal form of the nature previously discussed relative to FIG. 1. More particularly, the trapezoidal form includes side walls 50 and 52 extending upwardly and connected to a bottom wall 54. In this embodiment of the invention, the frame which is planar is indicated generally at 56 and supports three reinforcing bars or rods 58, 60 and 62.

The frame 56 is generally of A-shape and includes two legs 64 and 66 which are of diverging relationship and intersect in the general area indicated at 68. The legs 64 and 66 have two extremities 70 and 72, which are located distally with respect to intersection 68. At these distal ends 70 and 72 are located two feet 74 and 76 which are cylindrical in shape. Also included in the frame 56, is a cross-bar 78 which intersects with the legs 64 and 66 at locations generally indicated at 80 and 82. Feet 74 and 76, it will be noted, extend perpendicularly to the plane of frame 56 and in this direction are of substantially greater extent than the frame to lend stability to the frame.

Sockets 84, 86 and 88 are provided. Socket 84 which constitutes a supporting portion, as referred to hereinabove with respect to the earlier described embodiments, is located at intersection 68 and opens directly upwards. Sockets 86 and 88 are also support portions as described hereinabove, but open in an obliquely upwards direction. The distal ends 70 and 72 of legs 64 and 66 are located laterally outside of sockets 86 and 88 and, thus, are normally engaged with the side walls 50 and 52.

Referring to the embodiment illustrated in FIGS. 4–7 and as well to FIG. 1 showing a perspective view of a concrete form with the previously described embodiments, it will be seen that there has been disclosed in combination, a concrete form of inverted trapezoidal cross-section including a bottom wall and side walls connected thereto, a plurality of parallel reinforcing rods which are located in the form and at least one monolithic plastic reinforcing rod support holding the reinforcing rods in position in the inverted trapezoidal concrete form.

Referring to all of the embodiments in general, the aforesaid support includes a frame and support portions on the frame for elastically receiving and retaining the reinforcing rods. At least one of the support portions is located at a higher level in the form than at least a second of the support portions. This higher support portion opens directly upwards. As a result, forces which tend to implant a reinforcing rod therein, will be accommodated directly and will tend simply to urge the extremities of the support more tightly against the opposing side wall of the concrete form. The lower support portion or support portions open obliquely upwards as a consequence whereof forces tending to implant reinforcing rods therein will tend to be opposed by engagement of the various types of frames with the bottom and/or the side walls of the concrete form. Moreover, it will be noted that all of the frames provided in accordance with the invention, include laterally extending portions engaging against the side walls and adapted for being urged against the side walls of the concrete form by the weight of the reinforcing rods when accommodated in the supporting portions or sockets.

The last embodiment to be described comprises an A-shaped frame including diverging legs, defining an inverted V and a cross-bar extending between the said legs, said frame including peripheral rod sockets for elastically receiving and retaining respective reinforcing rods, said frame and sockets being as in the aforegoing embodiments, a monolithic plastic structure.

The diverging legs, as has been noted, intersect with each other and with the aforesaid cross-bar and said sockets are located preferably at the intersections of the legs with each other and with the cross-bar. With the frame upright, the socket at the intersection of the legs opens directly upwardly and the sockets at the intersections of the legs with the cross-bar open obliquely upwards.

The legs have ends which are located distally with respect to the intersection of the legs, said ends extending laterally outside of the sockets located at the intersections of the legs and cross-bar. Cylindrical feet are provided on the distal ends of said legs.

FIGS. 8–11 show a further embodiment of the invention in which an A-frame 90 includes diverging legs 92 and 94 intersecting at apex 96 and provided with a cross-bar 98. Arms 100 and 102 extend outwardly from apex 96 to a greater extent than legs 92 and 94 which terminate at cylinders 104 and 106.

Rod socket 108 is supported on the frame at apex 98 and rod socket 110 is supported centrally on cross-bar 98. Both sockets open upwardly. Below socket 110 is a vertical extension 112 terminating in cylinder 114.

Figure 8:
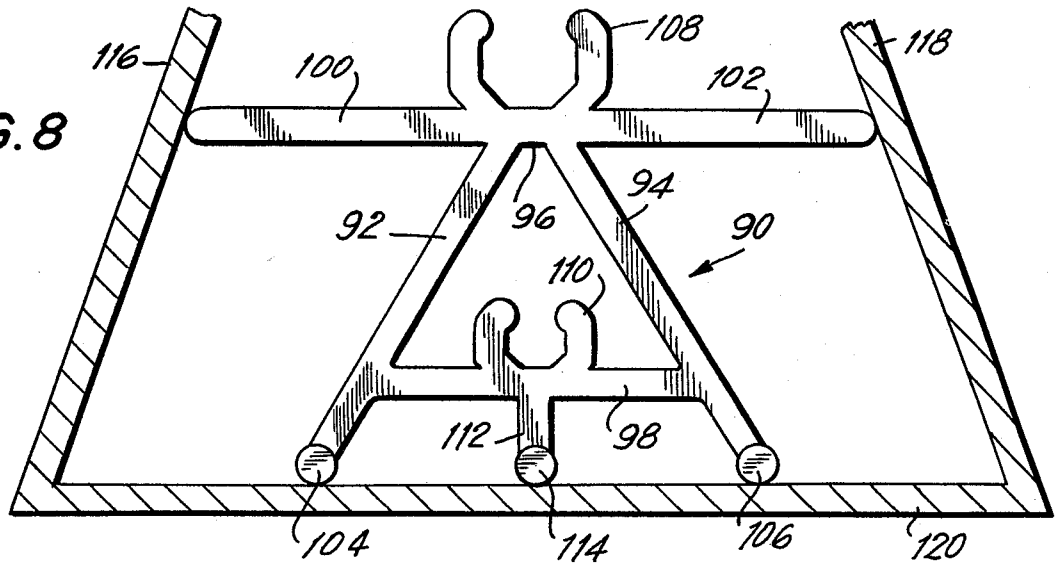
FIG. 8 is a front view of a fourth embodiment.
Figure 10:
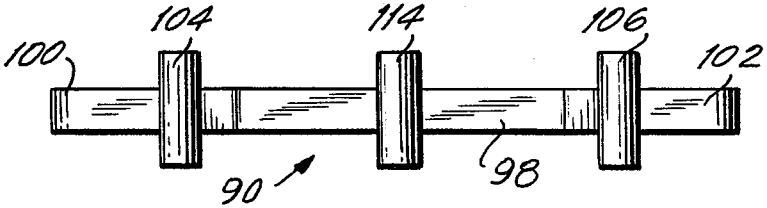

This last embodiment is preferred for upside down casting of hog slats as shown by a form in FIG. 8 including walls 116 and 118 connected to floor 120 collectively providing a trapezoidal form in which the floor supports cylinders 104, 106 and 114 with the side walls being engaged by arms 100 and 102.

The flexibility of arms 100 and 102 of the support which is, as are the other embodiments, a monolithic plastic structure, enables the support to be wedged in position within the form to receive reinforcing rods in sockets 108 and 110. Extension 112 affords additional supporting strength to the construction in alignment with sockets 108 and 110.

Although the invention has been described in relation to some specific embodiments thereof, it is clear that numerous modifications and variations will become evident to those skilled in the art without departing from the scope and spirit of the invention as defined by the attached claims.

What is claimed is:

1. In combination: a concrete form of inverted trapezoidal cross-section including a bottom wall and side walls connected thereto, a plurality of parallel reinforcing rods in said form and at least one monolithic plastic reinforcing rod support holding said rods in position in said form, said support including an A-shaped frame and support portions on said frame for elastically receiving and retaining said reinforcing rods, at least one of the support portions being located at a higher level in the form than a second and third of the support portions, said one support portion opening directly upwards and said second and third support portions opening obliquely upwards, said frame including laterally extending portions in the form of diverging legs forming an inverted V and engaging against said walls and being adapted for being urged against the side walls by the weight of the reinforcing rods in said support portions, said frame including a cross-bar extending between said legs and including ends at which said second and third support portions are respectively positioned.

2. In combination: a concrete form of inverted trapezoidal cross-section including a bottom wall and side wall connected thereto, a plurality of parallel reinforcing rods in said form, and at least one monolithic plastic reinforcing rod support holding said rods in position in said form, said support including an A-shaped frame and support portions on said frame for elastically receiving and retaining said reinforcing rods at least one of the support portions being located at a higher level in the form than a second of the support portions, said support portions opening directly upwards, said frame including laterally extending portions in the form of diverging legs forming an inverted V and engaging against said walls and being adapted for being urged against the side walls by the weight of the reinforcing rods in said support portions and a vertical support extending downwardly from said cross-bar below said second support portion.

3. A reinforcing bar support comprising an A-shaped frame including diverging legs defining an inverted V and a cross-bar extending between said legs, and rod sockets on said frame for elastically receiving and retaining respective reinforcing rods, said frame and sokets being a monolithic plastic structure, said diverging legs intersecting with each other and with said cross-bar and said sockets being located at the intersections of the legs with each other and with the cross-bar.

4. A support as claimed in claim 3, wherein with the frame upright, the socket at the intersection of the legs opens directly upwardly and the sockets at the intersection of the legs with the cross-bar open obliquely upwards.

5. A support as claimed in claim 4, wherein said legs have ends which are located distally with respect to the intersection of the legs, said ends extending laterally outside of the sockets located at the intersections of the legs and cross-bar.

6. A support as claimed in claim 5, comprising cylindrical feet on the distal ends of said legs.

7. A support as claimed in claim 3, wherein said diverging legs intersect at an apex-whereat one of said rod sockets is located and said cross-bar supports a second of said sockets between said legs.

8. A support as claimed in claim 7, comprising horizontal arms extending outwardly from said apex.

9. A support as claimed in claim 8, comprising a vertical extension extending downwardly from said cross-bar below the second socket.

10. A support as claimed in claim 8, wherein said arms extend outwardly to a greater extent than said legs.

* * * * *